US006931224B2

(12) United States Patent
Foster et al.

(10) Patent No.: US 6,931,224 B2
(45) Date of Patent: Aug. 16, 2005

(54) TONER CARTRIDGE HOPPER WITH LABYRINTH CHANNELS FOR RELEASING AIR WHILE TRAPPING TONER IN CARTRIDGE

(75) Inventors: Mark Duane Foster, Lexington, KY (US); Robert Watson McAlpine, Lexington, KY (US); Robert Francis Soto, Lexington, KY (US); Gregory Scott Tigges, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 121 days.

(21) Appl. No.: 10/715,771

(22) Filed: Nov. 18, 2003

(65) Prior Publication Data

US 2005/0105931 A1 May 19, 2005

(51) Int. Cl.[7] ..... G03G 15/08

(52) U.S. Cl. ..... 399/98; 399/262

(58) Field of Search ..... 399/98, 262, 258, 399/119, 120

(56) References Cited

U.S. PATENT DOCUMENTS 5,758,231 A 5/1998 Coffey et al.

*Primary Examiner*—Quana Grainger
(74) *Attorney, Agent, or Firm*—John Brady; Navarro Law Offices, P.C.

(57) ABSTRACT

A vent integral with the top surface of toner hopper (5) having three labyrinth channels (3*a*–3*c*) oriented in one direction and three labyrinth channels (3*d*–3*f*) oriented in an orthogonal direction. Each labyrinth communicates with the inside of the hopper by a hole (13*a*–13*f*) and the end of each labyrinth communicates with filter pad (7) held in a basin (11) formed in the top surface of hopper (5). Cover (9) closes the vent except for hole (15) over the center of pad (7).

7 Claims, 3 Drawing Sheets

TONER CARTRIDGE HOPPER WITH LABYRINTH CHANNELS FOR RELEASING AIR WHILE TRAPPING TONER IN CARTRIDGE

TECHNICAL FIELD

This invention relates to toner cartridges having a vent to release air ingested around seals in the cartridge as the components move or by impacts during handling of the cartridge. The vent releases air while trapping toner to prevent expulsion of toner.

BACKGROUND OF THE INVENTION

A toner cartridge having a plug with a filter is described in U.S. Pat. No. 5,758,231 to Coffey et al. The plug has a labyrinth followed by a felt filter and having several entrance holes to the labyrinth used to vent the cartridge. Since this plug is in the side of the cartridge, the filtering will not be effective in a cartridge having toner in amount that reaches the plug.

Relocating the plug higher presents structural and operational conflicts. The use of a plug makes it necessary to have a hole in the toner hopper in which the plug is pressed. The size of the hole and the requirement to seal around it limits the locations on the hopper where the venting plug can be placed.

DISCLOSURE OF THE INVENTION

This invention does not employ a plug, but instead incorporates a labyrinth and seat for a filter in the cartridge itself. This can be on or near the top of the cartridge. A plurality of labyrinth channels are provided, each with an input hole communicating with the inside of the toner hopper. The labyrinth channels cause toner moving in air to impact the walls of the labyrinth or at least change direction, thereby losing kinetic energy before they reach the filter. Since a toner cartridge during shipment or other handling may be impacted from any direction, labyrinth channels are provided in orthogonal directions.

The labyrinth channels exit into a basin also formed on the cartridge surface having a filter pad. The filter pad passes air, but not the toner.

The vent is completed with a cover attached, preferably by adhesive, over the labyrinth channels and the filter. The cover has a vent hole or vent holes located at or near the center of the filter pad, so as to require expelled air to have traversed at least a large part of the filter.

Preferably, all structures but the filter pad and the cover are molded into the cartridge at the time the cartridge is created in a mold. This avoids the costs of separate creation of those elements. The filter pad and the cover are applied separately.

BRIEF DESCRIPTION OF THE DRAWINGS

The details of this invention will be described in connection with the accompanying drawings, in which.

DESCRIPTION OF THE PREFERRED EMBODIMENTS

Figure 1:
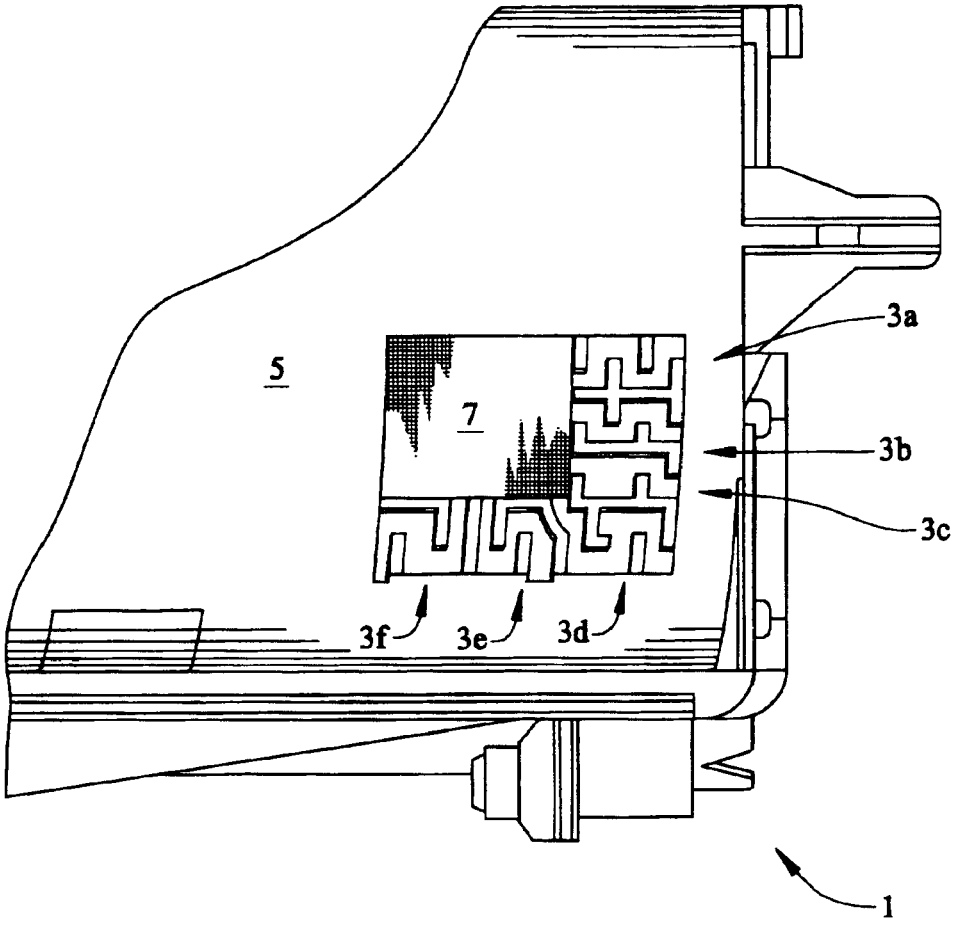
FIG. 1 shows part of a toner cartridge from the top of a hopper of the cartridge carrying toner.

FIG. 1 is a top view of an electrophotographic toner cartridge 1 (partially shown) having labyrinth channels 3*a*, 3*b*, 3*c*, 3*d*, 3*e*, and 3*f* formed integral a part of the toner hopper 5 of cartridge. 1. Filter pad 7 is shown, being a rectangular felt pad to which all of the channels 3*a*–3*f* face. As the cover 9 (FIG. 3) is not illustrated in FIG. 1, FIG. 1 does not illustrate the finished vent.

Filter pad 7 in this embodiment is felted NOMEX synthetic aromatic polyamide polymer. This material is commercially available and known as a very good filter material.

Labyrinth channels 3*a*–3*f* are preferably a simple extension of the material of hopper 5 and are formed as part of the same molding operation by which hopper 5 is formed. Similarly, as shown in FIG. 2 a rectangular basin 11 in which pad 7 is placed is preferably formed in hopper 5 as part of the molded configuration of hopper 5.

Figure 2:
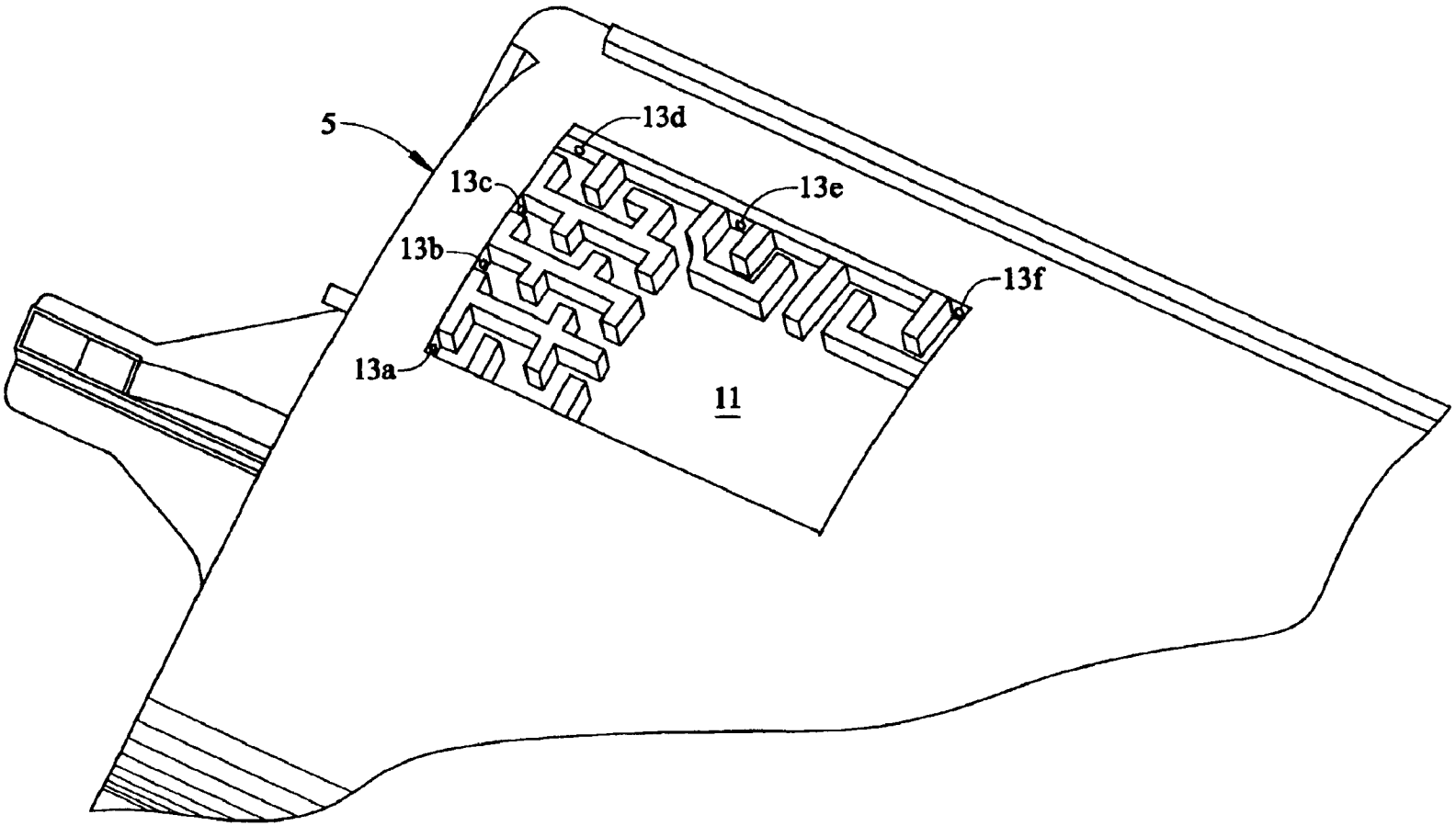
FIG. 2 is a perspective view of the same structures shown in FIG. 1 with the filter pad and cover omitted to better illustrate the labyrinth channels and the basin which receive the filter pad.

As best shown in FIG. 2, each labyrinth channel 3*a*–3*f* has an entrance hole 13*a*, 13*b*, 13*c*, 13*d*, 13*e*, and 13*f* at the end distant from basin 11 which reach the inside of hopper 5 to form an open passage to the inside of hopper 5. Each of the labyrinth channels 3*a*–3*f* has a series of vertical surfaces which are perpendicular to each other and thereby reverse the direction of air flow from holes 13*a*–13*f* respectively generally 90 degrees four times before the air reaches basin 11, which, in the finished vent, holds filter pad 7 (FIG. 1). The changes of direction are effective to reduce the momentum of toner particles so that they do not escape through pad 7.

Figure 3:
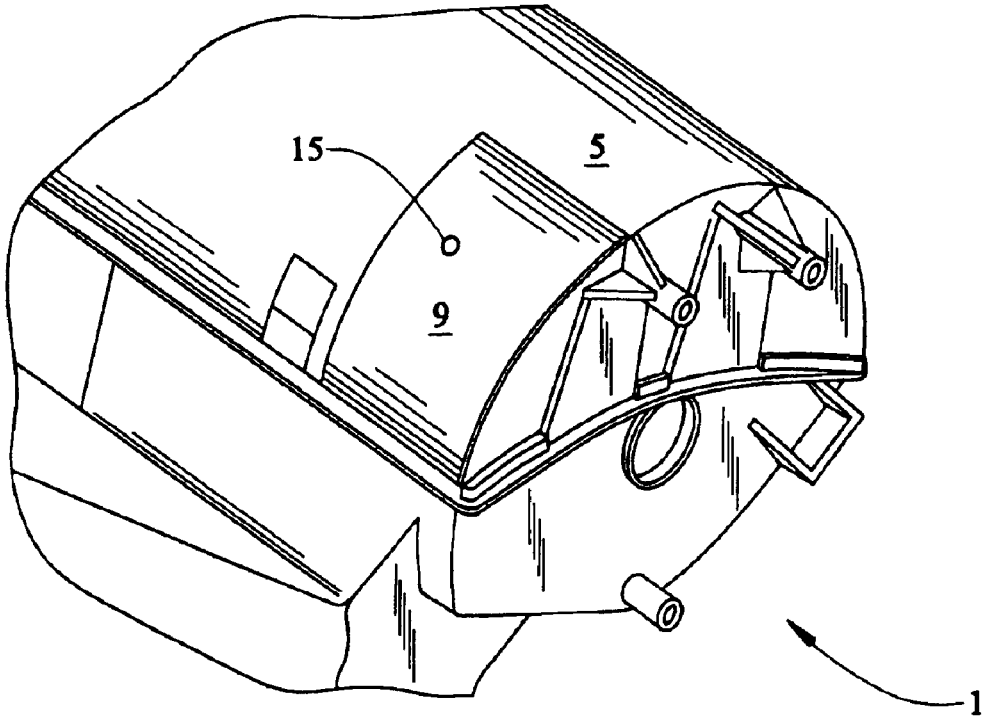
FIG. 3 is a view showing somewhat more the cartridge and showing the finished vent having its cover.

FIG. 3 shows the finished vent. Cover 9 is tightly held over both the channels 3*a*–3*f* and the pad 7 to require air in the vent to pass through the channels 3*a*–3*f* and the pad 7. This embodiment has a single hole 15, which is located generally over the center of pad 7. This location requires exiting air to have passed through a least one half of the body of pad 7.

Cover 9 in this embodiment is a thin (0.076 mm thick) sheet of MYLAR polyester plastic held on the top surface of hopper 5 by glue extending around all of its edges. Pad 7 and cover 9 may be applied by hand or by mechanical automation of the hand application. Alternatively, cover 9 could be a rigid member formed in a rounded shape to conform to hopper 5.

The location of the vent on the top of hopper 5 eliminates the concern of having so much toner in the hopper that it will be covered with toner.

Under normal operating conditions the labyrinth channels may not be essential to adequate filtering. However, movement and acceleration of the toner caused by vibration or impact during shipping may create enough force to allow the toner to exit through the filter material if the entrance and exit holes were directly opposite one another. The labyrinth then is necessary.

Multiple labyrinth channels and entrances are important in the event one becomes filled with toner and is no longer able to relieve the pressure. Also for that reason, the entrances to the labyrinths should lie on multiple axes such that one single impact would not force toner into all of the openings. In the embodiment shown the three channels 3*a*–3*c* are oriented orthogonal to the three channels 3*d*–3*f*.

The vent of this invention both provides for a high level of toner in a hopper and is an economical design. Variations will be apparent as labyrinth channels may take many forms and additional paths may be added to direct expelling air through a filter. The cover may take a variety of forms so long as it closes each labyrinth so that the labyrinth directs air through the filter.

What is claimed is:

1. A toner hopper comprising at least two labyrinth channels, each of said at least two labyrinth channels being oriented on said hopper different from the other on said toner hopper each of said labyrinth channels having an entrance in communication with the inside of said hopper, a filter pad attached to its surface in communication with the exit of each of said labyrinth channels, a cover over each of said labyrinth channels and said filter pad, and at least one hole in said cover over said filter pad, wherein air from inside said hopper is directed through each of said labyrinth channels, then through said pad, and then through said at least one hole in said cover.

2. The toner hopper as in claim 1 having three of said labyrinth channels oriented on said hopper in one direction and three of said labyrinth channels on said hopper oriented in a direction generally orthogonal to said one direction.

3. The toner hopper as in claim 2 in which said three labyrinth channels oriented in one direction and said three labyrinth channels oriented in an orthogonal direction are formed as a part of said hopper.

4. The toner hopper as in claim 1 in which said at least two labyrinth channels are formed as a part of said hopper.

5. The toner hopper having a vent attached to its upper surface, said vent having a labyrinth having a hole at its entrance reaching the inside of said hopper, a filter at the exit of said labyrinth, and a cover over said filter having a hole positioned over a middle area of said filter.

6. The toner hopper as in claim 5 in which said labyrinth has two channels, each of said channels being oriented on said hopper different from the other on said two channels.

7. The toner hopper as in claim 5 in which said labyrinth has three channels oriented on said hopper in one direction and three channels on said hopper oriented in a direction generally orthogonal to said one direction.

* * * * *